US006843669B2

(12) United States Patent
Drane et al.

(10) Patent No.: US 6,843,669 B2
(45) Date of Patent: Jan. 18, 2005

(54) ELECTRICAL TERMINATION MODULE

(75) Inventors: Mark R. Drane, Germantown, TN (US); Daniel K. Michaelis, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 10/307,889

(22) Filed: Dec. 2, 2002

(65) Prior Publication Data

US 2004/0106313 A1 Jun. 3, 2004

(51) Int. Cl.[7] ..... H01R 13/44
(52) U.S. Cl. ..... 439/142; 174/48
(58) Field of Search ..... 439/142, 135, 439/48; 174/48

(56) References Cited

U.S. PATENT DOCUMENTS

| | | | | |
|---|---|---|---|---|
| 4,381,063 A | | 4/1983 | Leong | 220/242 |
| 4,443,654 A | | 4/1984 | Flachbarth et al. | |
| 4,883,924 A | | 11/1989 | Hadfield | |
| 5,010,211 A | | 4/1991 | Bartee | |
| 5,032,690 A | | 7/1991 | Bloom | |
| 5,160,808 A | | 11/1992 | Hadfield | |
| 5,195,288 A | | 3/1993 | Penczak | |
| 5,272,278 A | | 12/1993 | Wuertz | |
| 5,342,993 A | | 8/1994 | Siems | |
| 5,382,171 A | * | 1/1995 | Hofmann et al. | 439/142 |
| 5,393,930 A | | 2/1995 | Wuertz | |
| 5,410,103 A | | 4/1995 | Wuertz | |
| 5,422,434 A | | 6/1995 | Wuertz et al. | |
| 5,466,886 A | | 11/1995 | Lengyel et al. | |
| 5,575,668 A | | 11/1996 | Timmerman | |
| 5,696,349 A | | 12/1997 | Bera | |
| 5,747,732 A | | 5/1998 | Bera et al. | |
| 5,763,826 A | | 6/1998 | Castellani et al. | |
| 5,783,774 A | | 7/1998 | Bowman et al. | |
| 6,018,126 A | | 1/2000 | Castellani et al. | |
| 6,046,405 A | | 4/2000 | Obermann | |
| 6,114,623 A | | 9/2000 | Bonilla et al. | |
| 6,175,078 B1 | | 1/2001 | Bambardekar et al. | |
| 6,179,634 B1 | | 1/2001 | Hull et al. | |
| 6,265,662 B1 | | 7/2001 | Riedy et al. | |
| 6,307,152 B1 | | 10/2001 | Bonilla et al. | |
| 6,395,978 B1 | | 5/2002 | Whitehead et al. | |

OTHER PUBLICATIONS

TradeMaster® Floor Box and Covers, *Pass & Seymour legrand®*, catalog description of Floor Box Covers (1999).

Thomas & Betts Electrical Components, Products and Systems *Technical/Specification Catalog* Electrical Components Division, catalog pp. J/830–J/867;J/897–J/900; M/990–M/996 (1994).

* cited by examiner

*Primary Examiner*—Javaid H. Nasri
(74) *Attorney, Agent, or Firm*—Hoffmann & Baron, LLP

(57) ABSTRACT

An electrical termination module including a side wall having an upper end attachable to a flange, the flange having a central opening. A cover is pivotally supported on the flange and a base plate is removably securable to a lower end of the sidewall. A first connection module is removably attached to the base plate. The first connection module housing a plurality of first electrical connectors.

28 Claims, 9 Drawing Sheets

ELECTRICAL TERMINATION MODULE

FIELD OF THE INVENTION

The present invention relates to an electrical termination module and more specifically an electrical termination floor module having a water resistant modular design.

BACKGROUND OF THE INVENTION

In office space and other commercial environments it is often desired to have access to electrical outlets or other electrical connections at locations located a distance from standard wall outlets. In order to safely accommodate such situations, floor boxes are typically used. These boxes may be located in the floor near or at the location, such as under a work cubicle or near a piece of machinery, where the connection is needed. The electrical connections may be electrical outlets, telephone jacks or data connections used for networking computers.

The prior art includes floor boxes that may be fitted in openings formed in concrete floors often found in commercial building. Such boxes may be set in poured concrete floors, in which case there location is fixed once the concrete sets. If the floor plan changes, thereby requiring connections at different locations, significant effort is involved to relocate or add addition floor boxes. This has become more problematic as the number of power, data and communications lines has increased. Each worker in an office may require various connections to computer networks, power, and telephones. Therefore, a change in floor plan could result in a large number of connection relocations. To address this problem, a modified construction method involves the uses of a raised floor, or access floor, above the concrete slab. This creates a space which is then used as a plenum for HVAC systems. Air is distributed to the habitable or working space through the use of air diffusers positioned in openings in the raised floor which communicate with the plenums. Such construction also provides space to run wiring thought. Electrical floor boxes may be inserted in the openings provided for the air diffusers. This provides a degree of flexibility which permits floor boxes to be moved and positioned with greater ease. However, while the location of the electrical floor boxes may be easily changed, the configuration of the prior art boxes to support various connectors cannot.

One type of floor box used with access floors is a Thomas & Betts base with a AFM-6 access floor module. This floor box can accommodate both power and voice/data connections. However, in order to change the configuration, considerable amount of wiring must be done on site as each connector must be unwired and a new connector wire up. This process is fairly time consuming and expensive.

Other floor outlet boxes are also known in house both power and data connectors. U.S. Pat. No. 6,307,152 discloses a floor box that houses both power connectors and voice/data connectors. The power connections are integrated on a central housing with the voice/data connectors being attachable about the central housing. The central housing and the power connectors are an integral part of the design. Therefore, if only data connectors were necessary for a particular location the power connectors which form part of the central housing would also be included. This creates an added expense due to the non-utilized components. Space is also wasted and only a limited number of voice/data jacks are provided.

U.S. Pat. No. 6,018,126 also discloses a floor box that houses both voice/data and power connectors. The box may be inserted in a hole in the floor which connects with a plenum. The connectors are attached to a central plate. The plate supports one standard duplex power outlet an four voice/data jacks. The ability to delete the voice/data connectors and increase the number of power outlets does not exist. An installer has little flexibility on site to configure the floor box to address a specific connection requirement.

Accordingly, it would be desirable to provide a termination module for housing electrical connectors which can be easily configured on-site to accommodate a particular connection requirement.

SUMMARY OF THE INVENTION

It is an advantage of the present invention to provide an electrical termination module for use in a floor.

It is a further advantage of the present invention to provide an electrical termination module having a modular design to permit field modification and ease of installation.

It is still a further advantage of the present invention to provide an electrical termination floor module having a modular design for accommodating power and data connectors.

In the efficient attainment of these and other advantages, the present invention provides an electrical termination module including side wall. A base plate is removably connected to a lower end of the side wall and a cover flange is supported on an upper end of the side wall. A cover is mounted to the cover flange and movable between an open and closed position. The base plate is adapted to support a first connection module which includes a plurality of electrical connectors secured in a housing. The first connections module is removably securable to the base plate.

As more particularly described by way of a preferred embodiment, the base plate further supports a second connection module. The first connection module is a power module providing a plurality of connections to a power source and the second connection module is a voice/data module providing a plurality of connections to voice/data lines. The first and second connection modules are self-contained units including a housing containing the plurality of connectors.

Also in a preferred embodiment, the cover flange includes a channel formed between an inner and outer wall. The outer wall includes a plurality of slots to permit water entering the channel to exit through the slots and away from the interior of the termination device. The cover includes a plurality of lids movable between an open and closed position. The lids permit wiring to exit through the cover when the cover is in the closed position.

DETAILED DESCRIPTION OF THE PREFERRED EMBODIMENTS

The present invention provides an electrical termination module which is preferably installable in a floor and houses electrical connections such as electrical outlets, and voice or data connectors. The present invention is particularly suitable for use in access floor applications where the floor surface is raised creating a space underneath. The electrical termination module may include one or more connection modules which are selectively employed in the field to accommodate particular connection requirements. The electrical termination module further provides water resistance features for protecting the connection modules from contamination.

Figure 1:
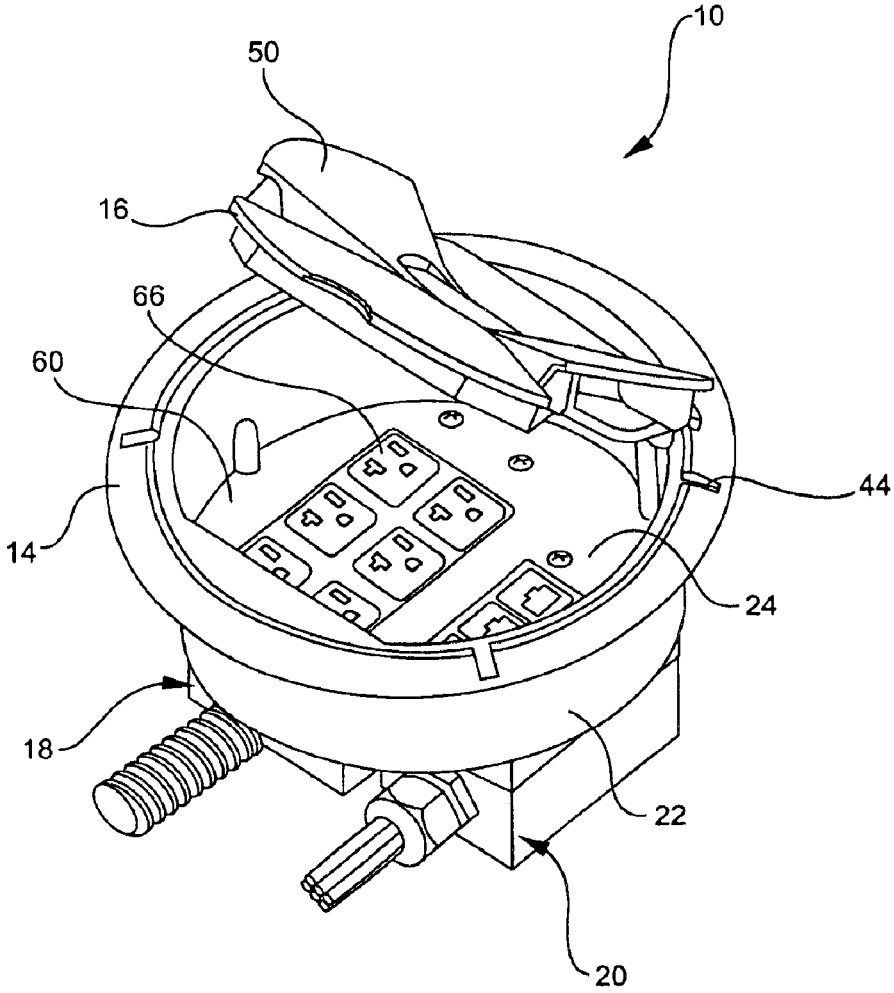
FIG. 1 is a top perspective view of the electrical termination module of the present invention.
Figure 2:
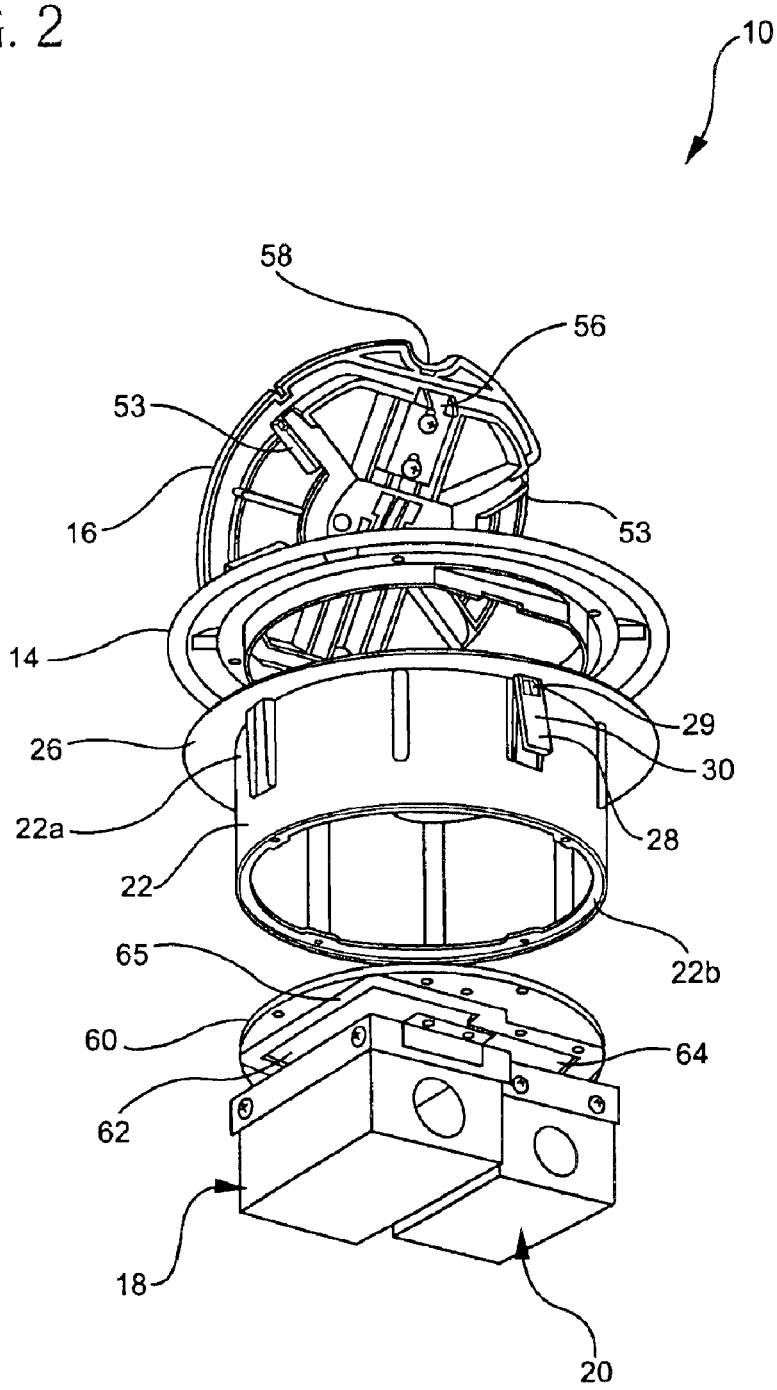
FIG. 2 is an exploded perspective view of the electrical termination module of FIG. 1.
Figure 3:
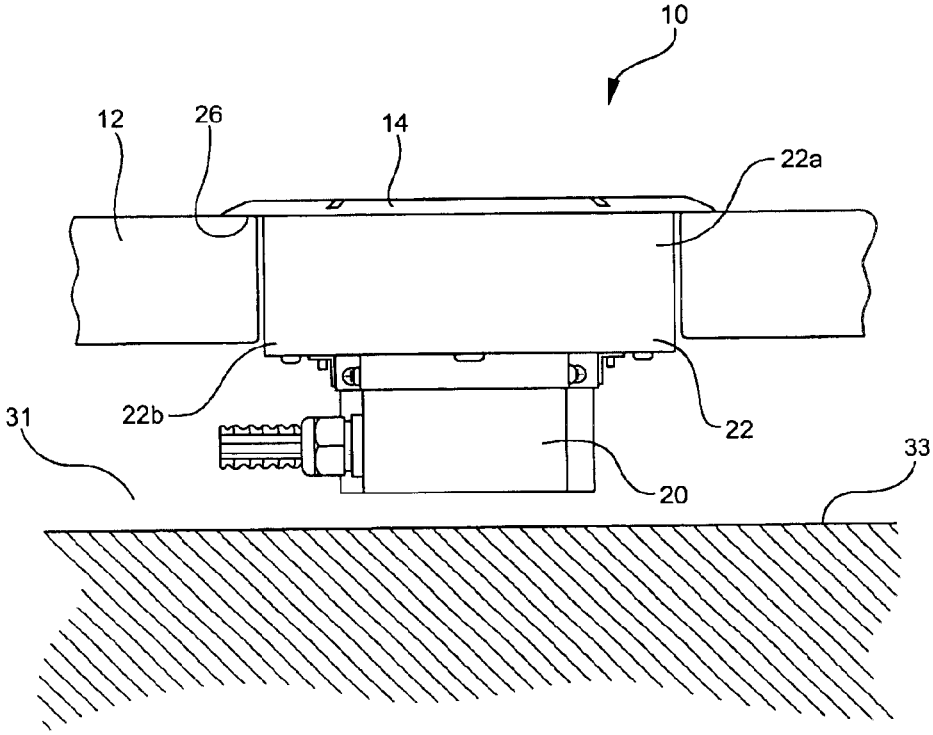
FIG. 3 is a side elevational view of the electrical termination module of FIG. 1.

Referring to FIGS. 1 to 3, electrical termination module 10 generally includes a side wall 22 attachable to a cover flange 14 to which a cover 16 is supported. A base plate 60 is secuarable to a lower end of side wall 22. A plurality of connection modules 18 and 20 which house electrical connectors are attachable to base plate 60. Side wall 22 and base plate 60 define an interior 24 into which plugs or other connection devices can enter to mate with the electrical connectors of the connection modules.

Electrical termination module 10 is adapted to be inserted into an opening in a floor 12 and secured therein. When installed in the floor, electrical termination module 10 sits substantially flush with the floor top surface such that it does not create an obstacle or impediment to walking. To facilitate installation in a floor opening, an upper end 22*a* of side wall 22 includes an outwardly extending collar 26 which is supported by the floor 12 when electrical termination module 10 is inserted therein as shown in FIG. 3. Side wall 22 may also include a securement device 28 for securing electrical box 10 in the floor 12. Securement device 28 preferable includes a pair of diametrically opposed tabs 30 pivotally attached to side wall 22. Tabs 30 are attached at an upper end to thumb screws 29. Upon advancement of the screws 29, tabs 36 pivot outwardly and engage the adjacent floor material. It is also within the contemplation of the present invention that a variety of securement devices such as clips or fasteners could be used as is known in the art. Side wall 22 is preferably formed of steel, but may be formed of a polymer or other material of the type typically used for forming electrical outlet boxes. Side wall 22 preferably has a substantially round configuration, however, it is within the contemplation that the shape of side wall 22 could be modified in order to accommodate various applications. The round configuration permits the orientation of the electrical termination module 10 to be adjusted once it is placed in the round floor opening so that the connectors are aligned to make connecting and unconnecting more convenient.

Referring particularly to FIG. 3, electrical termination module 10 with its round configuration is particularly suited for use in plenum floor construction in which a space 31 exists typically between a concrete slab 33 and the floor 12 raised and supported above it. Space 31 is used as a plenum through which cooled or heated is channel to provide HVAC to the habitable area. Such raised floors are typically fitted with openings in which air diffusers are inserted to channel the air in the plenum to the habitable area. The round side wall 12 of the present invention may be sized to be received in a air diffuser opening, thereby eliminating the need to form additional openings in the floor to accommodate electrical connection. A outer diameter of approximately 8 inches for side wall 22 will typically fix with in standard air diffuser openings. However, this dimension is merely illustrative and other configurations and dimensions could be used.

Referring to FIGS. 1 and 4–6, in order to prevent debris and moisture from entering electrical termination module 10 installed in the floor, cover 16 is employed. Cover 16 is securable to cover flange 14 and selectively covers and uncovers interior 24 to provide access to connections modules 18 and 20. In the preferred embodiment, cover 16 is pivotably attached to cover flange 14. Cover 16 may include a pair of spaced resilient protrusions 46 which are receivable in corresponding depressions 48 formed in cover flange 14. This arrangement permits cover 16 to be snapped in place and freely rotate between an open and closed position. It is within the contemplation of the present invention that any number of well known hinge devices may be used to achieve the pivot feature. Alternatively, cover 16 may be separable from cover flange 14 upon opening and rely on a friction fit to keep the cover in the closed position. Additionally, a securement wire (not shown) may be attached to cover 16 and cover flange 14 to ensure that cover does not become removed and separated from electrical termination module 10. Cover 16 may itself be secured in the closed position by the use of a spring loaded latch 56 supported on cover 16 (FIG. 2), which engages an adjacent portion of cover flange 14. Urging cover 16 upwardly to the open position overcomes the spring force and releases latch 56. A notch 58 is provided in cover 16 to facilitate opening of cover 16.

Figure 4:
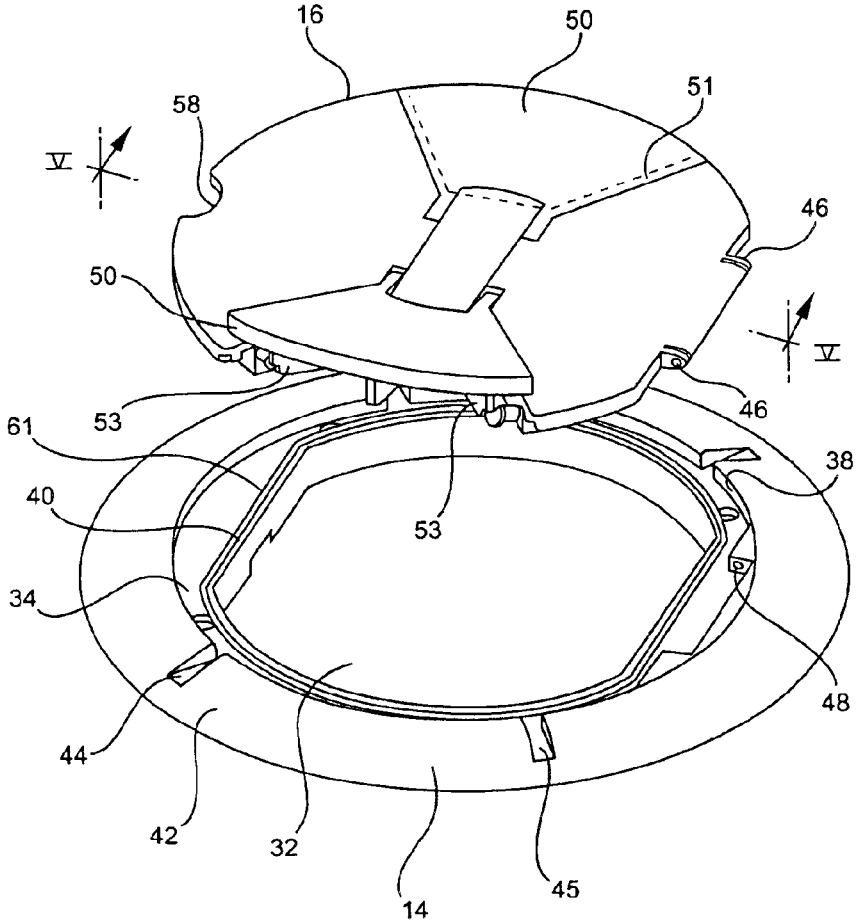
FIG. 4 is partial exploded view of the cover and cover flange of the present invention.

As shown in FIG. 4, cover 16 may further include one or more access lids 50 that are pivotably attached to cover 16. Lid 50 permits wires to pass through cover 16 when connection is required. In the preferred embodiment, cover 16 includes two such lids 50, one diametrically opposed from the other. The bottom surface of each lid 50 engages a resilient gasket 51 which prevents water from infiltrating through cover 16 to the inside of the box 10 when lids 50 are in the closed position. Gaskets 51 are generally U-shaped members supported by the cover 16 below the outer edges of lids 50.

Figure 7:
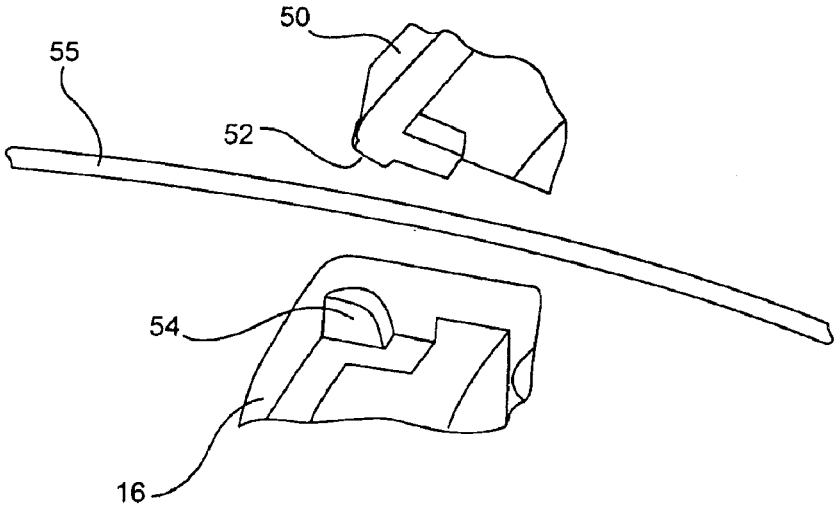
FIG. 7 is a partial detail view of the cover latch.

Referring to FIGS. 4 and 7, lids 50 may be secured in the closed position through the cooperation of a pin 52 and catch 54 located on the lid 50 and cover flange 14 respectively. To open a lid 50, lid 50 is translated radially outwardly such that pin 52 moves out of catch 54. Lid 50 may then be rotated to the open position. This may be done when cover 16 is in the open position. When cover 16 is then closed, ribs 53 (FIG. 4) rest on top of inner wall 40, thereby preventing lid 50 from closing on any wires 55 which may be extending through the opening created when lid 50 is in the open position. Accordingly, in the preferred embodiment, access lids 50 may only be opened or closed when cover 16 is in the open position.

Cover flange 14 is preferably an annular member having a central opening 32. Cover flange 14 includes a annular channel 34 having a bottom 36 peripherally bounded by an outer wall 38 and an inner wall 40. Extending radially beyond outer wall is an annular beveled surface 42. When electrical box 10 is installed cover flange 14 and cover 16 are slightly raised above the surface of the floor. Beveled surface 42 provides a smooth tapered transition from the floor to prevent tripping. Cover flange 14 further includes a plurality of slots 44 formed in the outer wall 38 and adjacent beveled ring 42 therein which creates interruptions in outer wall 38. Slots 44 provide a water resistance feature to the present invention.

Figure 5:
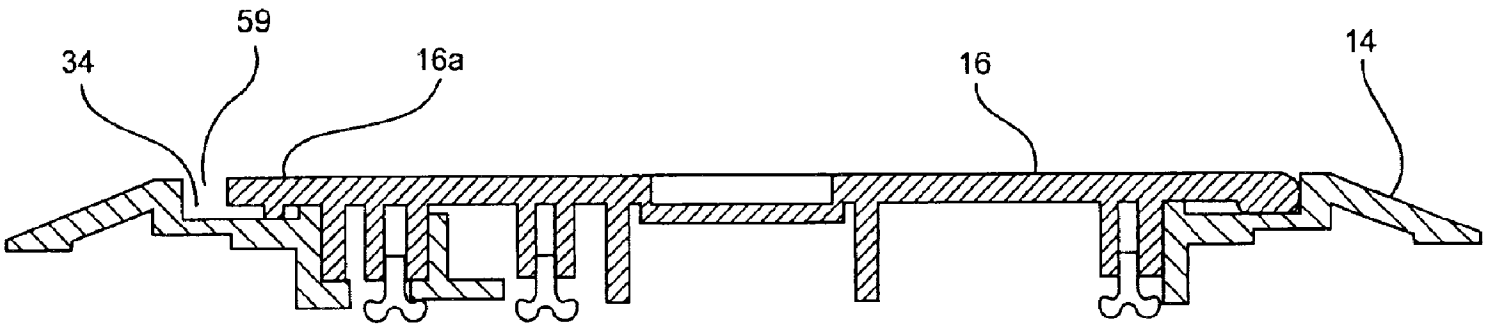
FIG. 5 is cross-sectional view of the cover and cover flange taken along line V—V of FIG. 4.
Figure 6:
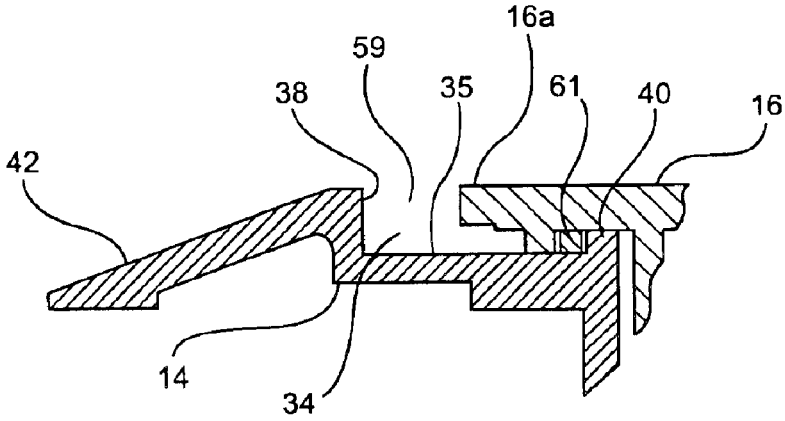
FIG. 6 is a cross-sectional detail view of the cover and cover flange.

Referring additionally to FIGS. 5 and 6, electrical termination module 10 provides resistance of the intrusion of water into the interior and protects the electrical connectors found within. When cover 16 is in the closed position, a radially outer portion 16*a* of the cover extends over a portion of channel 34 to prevent water from even entering channel 34. Accordingly, most of the water will run off the cover and down the beveled surface 42 of cover flange 14. A narrow gap 59 exists between the outer edge of cover 16 and cover flange 14. With cover 16 is in the closed position, water not shed directly off will be diverted to channel 34 through gap 59. Inner wall 40, which extends above channel bottom and the opening to slots 44, restricts water collected in channel 34 from entering the interior of the electrical termination module 10. Furthermore, a flange gasket 61 may be position about cover flange inner wall 40 to seal the gap between cover flange 14 and cover 16 including its access lids 50. Water in channel 34 will then be drained out through slots 44. Accordingly, when the cover 16 and cover flange 14 are exposed to water such as when the floors are cleaned or a liquid is spilled, the liquid will be shed away and not permitted to seep into the interior 24.

The present invention further permits ease of assembly and on-site modification through the use of connection modules 18 and 20. Connection modules 18 and 20 are preferably self-contained units including housings containing connectors which provide connection to electrical power or voice/data lines of the type commonly used in offices and other commercial settings. Module 18 is preferably a power module which houses multiple outlets 66 for supplying electricity to power equipment. Connection module 20 is preferably a voice/data module which permits connections to computer networks or telephone systems.

Connection modules may be selectively secured to side wall 22 by way of base plate 60 as shown in FIGS. 1 to 3. Base plate 60 is preferably a metallic plate formed separately from side wall 22. Base plate 60 may be fastened to the lower end 22*b* of side wall 22 using well known threaded fasteners. Base plate 60 could alternatively be held in place by using resilient clips or other fastening mechanisms well known in the art. Connection modules 18 and 20 may then be fastened to a bottom of base plate 60 which preferably includes a plurality of openings 62 and 64 to permit access to the connectors housed in the modules. A gasket 65 may be interposed between modules 18, 20 and base plate 60 to provide a seal there between. With modules 18 and or 20 installed, a user need only open cover 16 to obtain access to the connections.

Figure 8:
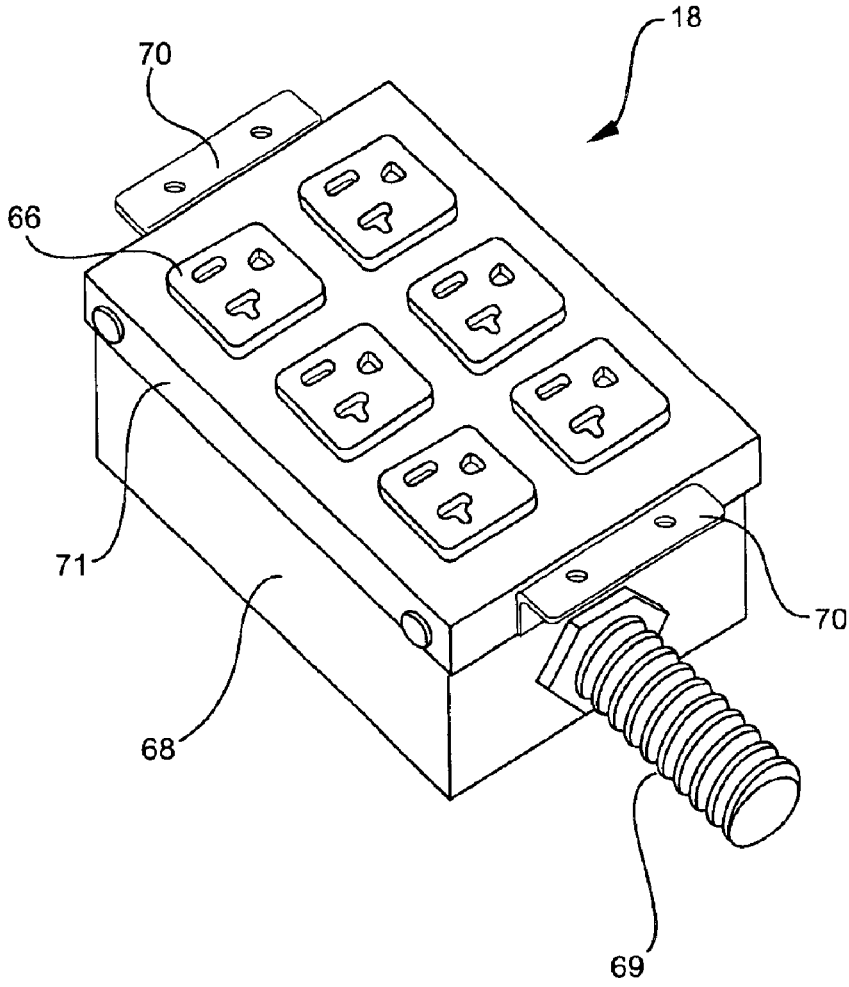
FIG. 8 is a top perspective view of the voice/data module of the present invention.

In the preferred embodiment shown in FIG. 8, power module 18 houses multiple outlets 66 for supplying power. Outlets 66, which may include standard 15A or 20A outlet configurations, would allow a user to plug in appliances such as lighting, tools, computer equipment, or any device requiring electricity. Outlets 66 could alternatively be of the GFI type. Power module 18 includes a box like housing 68 which houses the electrical outlets 66. Housing 68 may include a front face 71 which includes openings through which electrical outlets 66 extend. Housing 68 may be formed of a metal in a manner well known in the art. Flexible conduit 69 housing wires can be pass through an opening in box 68 to facilitate connection to the outlets in a manner similar to a standard duplex outlet box. Power module 18 may include a pair of mounting flanges 70 which permit power module 18 to be removable fastened to base plate 60.

Figure 9:
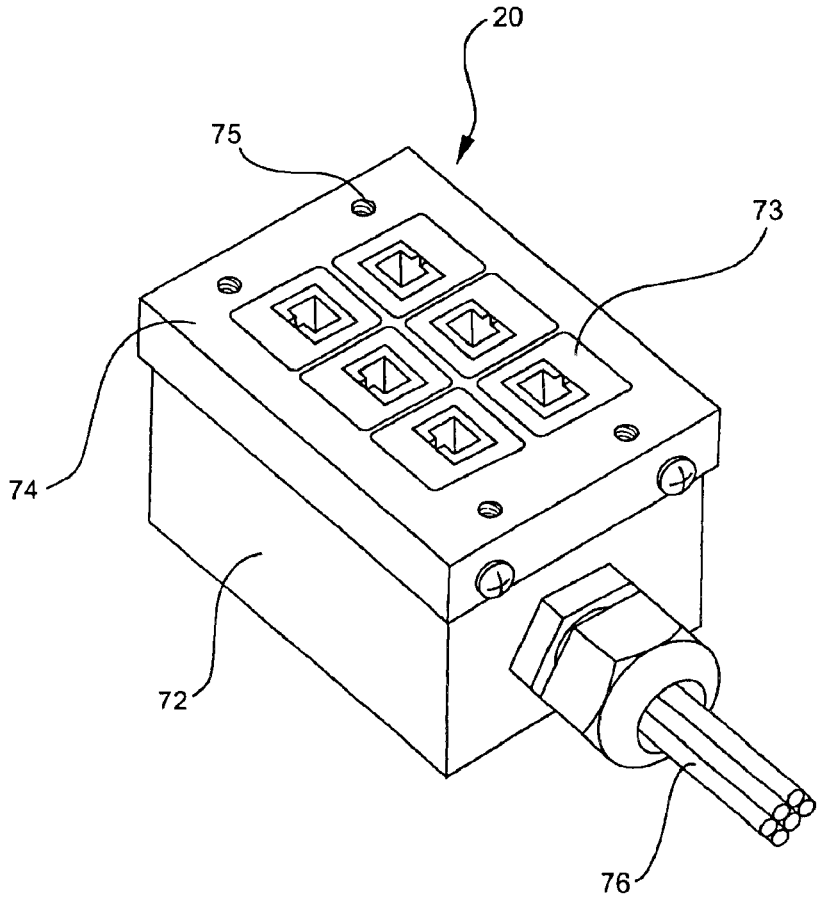
FIG. 9 is a top perspective view of the power module of the present invention.

Data module 20 shown in FIG. 9 permits connections to computer networks or telephone systems. Similar to power module 18, data module 20 includes a box like housing 72 which houses the voice/data connectors 73. Voice/data connectors may include RJ-45 jacks or other connectors as is known in the art. Housing 72 may include an opening to permit wiring 76 to pass into the box. A front face 74 of box 72 may include a plurality of threaded openings 75 which receive fasteners extending through openings in base plate 60 to removable attach data module to base plate 60. Alternatively, the front cover of housing 72 may include flanges (not shown) similar to those described above with respect to power module 18.

In order to further facilitate ease of installation, modules 18 and 20 may be pre-wired with a predetermined length of wire, cable or wiring housed in a flexible conduit extending out of the housings 68 and 72. With this arrangement an installer would only have to cut the wire to the desired length and connect the wires to a junction box or other connection point.

Through use of the self-contained connection modules 18 and 20, electrical termination module 10 may be easily configured to suit the particular connectivity need for each location. For example, if a particular location requires only a power module 18 and not a voice/data module 20, then only the power module is used and the base plate opening 64 to accommodate voice/data module 20 can be covered with a plate (not shown). Alternatively, if voice/data connections are only required, then the power module 18 is not used and the corresponding base plate opening 62 may be covered by a plate (not shown). Through the use of pre-wired connection modules, an installer does not have to wire each connector individually on-site, which would be very time consuming and expensive. Instead only the wires extending from the module would have to be connected to corresponding wires located in a junction box.

It is also within the contemplation of the present invention that base plate 60 may interchangeable with other base plates having opening of differing configurations such that two power modules could be provided or two data modules. Base plates having openings to accommodate other size boxes may also be provided. Therefore, an installer need only insert the correct base plate and attach the desired module or modules thereto. The modularity of the present invention permits on site flexibility giving the installer the ability to configure electrical termination module 10 as desired. No components go unutilized since only that the connectors which is are required are used. The modularity also permits the configuration of electrical termination module 10 to be easily modified as the connection requirements of a particular location change.

What is claimed is::

1. An electrical termination module comprising:

a side wall having an upper end attachable to a flange, the flange having a central opening;

a cover pivotally supported on the flange;

a base plate removably securable to a lower end of the side wall; and a first connection module being removably directly fastened to the base plate, the first connection module housing a plurality of first electrical connectors.

2. The termination module as defined in claim 1, further including a second connection module housing a plurality of second electrical connectors, the second connection module being removably attached to the base plate.

3. The termination module as defined in claim 2, wherein the plurality of first electrical connectors are functionally different from the plurality of second connectors.

4. The termination module as defined in claim 3, wherein the plurality of first connectors are power supplying outlets and the plurality of second connectors are voice/data connectors.

5. The termination module as defined in claim 1, wherein the base plate includes a first opening to provide access to the first connection module.

6. The termination module as defined in claim 2, wherein the base plate includes a first opening to provide access to the first connection module and a second opening to provide access to the second connection module.

7. The termination module as defined in claim 6, wherein the first connection module includes a housing and the first set of connectors are secured with the housing, the housing having an opening for accommodating wiring to the plurality of first connectors.

8. The termination module as defined in claim 1, wherein the flange includes an annular channel having a bottom peripherally bounded by an inner and outer wall, the flange further including a slot formed therein and in communication with the channel.

9. The termination module as defined in claim 8, wherein the inner wall extends above the channel bottom and the slot base such that water in the channel flows out of the slot before raising above the inner wall.

10. The termination module as defined in claim 8, wherein the inner wall defines the central opening.

11. The termination module as defined in claim 1, wherein the cover includes a first access lid pivotally attached thereto and movable between an open and closed position, the first access lid permitting wiring to pass through the cover when the cover is in the closed position.

12. The termination module as defined in claim 11, wherein the cover includes a second access lid pivotally attached to the cover.

13. The termination module as defined in claim 11, further including a seal disposed between the cover and the first access lid, the seal restricting water from passing through the cover when the first access lid is in the closed position.

14. The termination module as defined in claim 8, further including a gasket disposed in the channel, the gasket providing a seal between the cover and the flange.

15. An electrical termination module comprising:

a side wall having an upper end attachable to a flange, the flange having a central opening;

a cover pivotally supported on the flange;

a base plate removably securable to a lower end of the side wall;

a first connection module being removably attached to the base plate, the first connection module including a housing containing a plurality of first electrical connectors;

a second connection module being removably attached to the base plate, the second connection module including a housing containing a plurality of second electrical connectors, and the base plate includes a first opening to provide access to the first connection module and a second opening to provide access to the second connection module.

16. The termination module as defined in claim 15, wherein the first and second connection modules are self contained units.

17. The termination module as defined in claim 15, wherein the side wall includes a securement device for attaching the termination module to a floor.

18. An electrical termination module comprising:

a side wall having an upper end attachable to a flange, the flange having a central opening;

a cover pivotally supported on the flange, the cover including a first access lid pivotally attached thereto and movable between open and closed position, the lid including a member engagable with the flange when the cover is in the closed position to maintain the lid in the open position when the cover is in the closed position;

a base plate removably securable to a lower end of the side wall; and a first connection module being removably attached to the base plate, the first connection module housing a plurality of first electrical connectors.

19. An electrical termination module comprising:

a side wall having an upper end attachable to a flange, the flange having a central opening;

a cover pivotally supported on the flange;

a base plate having a first and second opening removably securable to a lower end of the side wall, the side wall and base plate forming an interior adapted to receive connection devices;

a first connection module being removably fastened to the base plate, the first connection module housing a plurality of first electrical connectors, the first connection module being aligned with the base plate first opening; and a second connection module fasten to the base plate and being aligned with the base plate second opening.

20. An electrical termination module comprising:

a side wall having an upper end attachable to a flange, the flange having a central opening;

a cover pivotally supported on the flange, the flange including an annular channel having a bottom peripherally bounded by an inner and outer wall, the flange further including a slot formed therein and in communication with the channel;

a base plate having a first opening removably securable to a lower end of the side wall, the side wall and base plate forming an interior adapted to receive connection devices; and a first connection module being removably fastened to the base plate, the first connection module housing a plurality of first electrical connectors.

21. An electrical termination module comprising:

a side wall having an upper end attachable to a flange, the flange having a central opening, the flange including an annular channel having a bottom peripherally bounded by an inner and outer wall, the flange further including a slot formed therein and in communication with the channel;

a cover pivotally supported on the flange;

a base plate removably securable to a lower end of the side wall; and a first connection module being removably attached to the base plate, the first connection module housing a plurality of first electrical connectors.

22. An electrical termination module comprising:

a side wall having an upper end attachable to a flange, the flange having a central opening;

a cover pivotally supported on the flange, the cover including a first access lid pivotally attached thereto and movable between an open and closed position, the first access lid permitting wiring to pass through the cover when the cover is in the closed position;

a base plate removably securable to a lower end of the side wall; and a first connection module being removably attached to the base plate, the first connection module housing a plurality of first electrical connectors.

23. An electrical termination module comprising:

a side wall having, and extending between, a first and second end, the first end being attachable to a flange, the flange having a central opening;

a cover pivotally supported on the flange;

a base plate having a first opening and being removably securable the side wall second end, the side wall and base plate forming an interior adapted to receive connection devices; and a first connection module being removably fastened to the base plate, the first connection module housing a plurality of first electrical connectors.

24. The term nation module as defined in claim 23, wherein the cover includes an access lid pivotally attached thereto and moveable between an open and closed position.

25. The termination module as defined in claim 23, wherein the flange includes an annular channel having a bottom peripherally bounded by an inner and outer wall, the flange further including a slot formed therein and in communication with the channel.

26. The termination module as defined in claim 23, wherein the first connection module is aligned with the base plate first opening, and the base plate includes a second opening which aligns with a second connection module fastened to the base plate.

27. The term nation module as defined in claim 1, wherein the cover includes a first access lid pivotally attached thereto and movable between an open and closed position, the lid including a member engagable with the flange when the cover is in the closed position to maintain the lid in the open position when the cover is in the closed position.

28. An electrical termination module comprising:

a side wall having an upper end attachable to a flange, the flange having a central opening;

a cover pivotally supported on the flange, the cover including an access lid pivotally attached thereto and moveable between an open and closed position;

a base plate having a first opening removably securable to a lower end of the side wall, the side wall and base plate forming an interior adapted to receive connection devices; and a first connection module being removably fastened to the base plate, the first connection module housing a plurality of first electrical connectors.

* * * * *

UNITED STATES PATENT AND TRADEMARK OFFICE

CERTIFICATE OF CORRECTION

PATENT NO. : 6,843,669 B2
DATED : January 18, 2005
INVENTOR(S) : Drane et al.

It is certified that error appears in the above-identified patent and that said Letters Patent is hereby corrected as shown below:

Column 9,
Line 13, now reads "The term nation module…", and should read -- The termination module… --

Column 10,
Line 3, now reads "The term nation module…", and should read -- The termination module… --

Signed and Sealed this

Twenty-sixth Day of April, 2005

JON W. DUDAS
*Director of the United States Patent and Trademark Office*